United States Patent [19]

Takeguchi et al.

[11] Patent Number: 4,955,357

[45] Date of Patent: Sep. 11, 1990

[54] METHOD AND APPARATUS FOR CUTTING POLYCRYSTALLINE SILICON RODS

[75] Inventors: Masakatsu Takeguchi, Suzuka; Takashi Yamamoto; Mamoru Nakano, both of Yokkaichi, all of Japan

[73] Assignee: Hi-Silicon Co., Ltd., Japan

[21] Appl. No.: 147,213

[22] Filed: Jan. 22, 1988

[51] Int. Cl.[5] ..... B28D 5/04

[52] U.S. Cl. ..... 125/23.01; 125/35; 225/1; 225/97; 225/103

[58] Field of Search ..... 225/1, 97, 103; 125/6, 125/7, 8, 23 R, 29, 23 C, DIG. 1, 35; 83/365

[56] References Cited

U.S. PATENT DOCUMENTS

| | | | |
|---|---|---|---|
| 2,557,098 | 6/1951 | Graham et al. | 125/23 C |
| 2,874,688 | 2/1959 | Biesanz, Sr. et al. | 125/23 C |
| 2,888,915 | 6/1959 | Entz et al. | 125/23 C |
| 3,257,055 | 6/1966 | Arnott | 225/103 X |
| 3,901,423 | 8/1975 | Hillberry et al. | 225/2 |
| 4,158,976 | 6/1979 | Ditges | 83/365 |
| 4,562,628 | 1/1986 | Marneffe et al. | 125/23 C |
| 4,693,403 | 9/1987 | Sprouse | 125/23 R |

FOREIGN PATENT DOCUMENTS

| | | | |
|---|---|---|---|
| 8400404 | 9/1985 | Netherlands | 123/23 R |

*Primary Examiner*—Frank T. Yost
*Assistant Examiner*—Rinaldi Rada
*Attorney, Agent, or Firm*—Webb, Burden, Ziesenheim & Webb

[57] ABSTRACT

A method and apparatus for cutting polycrystalline silicon rods which comprise applying pressing forces at at least two positions on a plane perpendicular to the longitudinal axis of a polycrystalline silicon rod at a plurality of positions symmetrical to said axis.

11 Claims, 3 Drawing Sheets

METHOD AND APPARATUS FOR CUTTING POLYCRYSTALLINE SILICON RODS

FIELD OF THE INVENTION

High purity elementary silicon, a most important electronic semiconductor material, is produced by thermal decomposition of monosilane, trichlorosilane, tetrachlorosilane, etc., first as polycrystalline rods. The polycrystalline elementary silicon rods have to be cut into smaller lumps of suitable size in order to be converted to monocrystalline silicon. This invention relates to a method and an apparatus for cutting polycrystalline silicon rods.

BACKGROUND OF THE INVENTION

Polycrystalline silicon rods are conventionally cut by a rotating saw comprising a rotating saw such as a diamond wheel. Usual polycrystalline silicon rods have a diameter of 50–150 mm, and the cutting speed by the rotating saw is 5–15 mm/min. Therefore, considerable time is required to cut a rod into a plurality of shorter lumps. The recent trend toward producing silicon rods in larger diameters makes it particularly important to expedite the cutting of silicon rods.

We have found that a polycrystalline silicon rod can be easily cut if pressing forces are applied on a plane perpendicular to the longitudinal axis of the silicon rod toward the axis of the rod at evenly located positions on the periphery of the rod by means of wedge edges. This invention was accomplished on the basis of this finding.

DISCLOSURE OF THE INVENTION

This invention provides a method of cutting a polycrystalline silicon rod, which comprises applying pressing forces on a plane perpendicular to the longitudinal axis of the rod toward the axis of the rod at at least two positions on the periphery of the rod symmetrical to the axis of the rod by means of wedge edges.

This invention also provides an apparatus for cutting a polycrystalline silicon rod which comprises a means for supporting a polycrystalline silicon rod; a plurality of cutting edges arranged on a plane perpendicular to the longitudinal axis of the silicon rod along the periphery of the rod at the positions symmetrical to the axis, said cutting edges being movable in the radial direction; and a means for driving said edges for applying equal pressing forces toward the axis of the rod.

It is presumed that when pressing force exceeding the strength of the material in the radial direction is applied to a polycrystalline material by means of cutting edges, brittle fracture is caused along the direction of pressing forces and the direction parallel to the circumference, and thus the rod is flatly severed.

The method of the present invention can be practically carried out by means of the apparatus of the present invention.

The number of the cutting edges are at least two, which are positioned at diametrically opposite sides. Three edges arranged at 120° intervals, four edges arranged at 90° intervals and six edges arranged at 60° intervals will also do.

Six edges arranged at 60° intervals are preferred. By this arrangement, a very flat and smooth sectional plane without peripheral irregularity can be obtained.

The preferred angle $\alpha$ of the cutting edge is between 60° and 120°. More preferred is an angle between 75° and 100°. Generally, an edge of a sharper angle tends to cut into the rod and fail to sever it. On the contrary, an edge of a more obtuse angle gives irregular cross-sectional surface. The cutting edge is preferably made of a hard alloy such as high speed steel or sintered alloys, since these alloys can be used for a prolonged period of time.

The cutting edges are arranged on a plane perpendicular to the longitudinal axis of a rod to be cut along the periphery of the rod so as to be movable in the radial direction, and are moved by a driving means so as to exert pressing forces on the rod. As the driving means, a hydraulic cylinder can be used. Specifically, for each cutting edge, a hydraulic cylinder is positioned in the radial direction of the rod and a cutting edge is secured at the end of the piston rod of the hydraulic cylinder. The driving force of such a hydraulic cylinder should preferably be variable. In the initial stage until all the cutting edges come into contact with the rod surface, very weak forces should be applied. Once all the cutting edges contact the rod surface, high pressing forces should be applied so as to sever the rod instantaneously.

The apparatus is provided with a means to carry the rod and to feed it to the cutting station cut by cut. Such a means may, for instance, comprise a roller conveyer and a suitable driving means such as a motor.

The cutting apparatus can, of course, be automatically operated by sequence control or by a microcomputer as programmed. For instance, an apparatus can be constructed as follows. A photosensor is spaced from the cutting edges by a distance equal to the length of a lump to be cut from a rod. When a rod is carried forward until the end thereof reaches the position of the photosensor, the rod halts and the cutting edges operate to sever the rod. After the rod is severed, the remaining part of the rod is again fed forward. This cycle of operation is repeated.

The method of this invention expedites the silicon rod cutting operation making use of the brittle fracture property of polycrystalline silicon, and is thus effectively applicable to silicon rods of larger diameters which are expected to be produced from now on. The quality of the severed surface produced by the method and apparatus of the present invention compares admirably with the surface obtained by the conventional cutting saw.

BRIEF EXPLANATION OF THE ATTACHED DRAWINGS

SPECIFIC DESCRIPTION OF THE EMBODIMENT OF THE INVENTION

The invention will now be specifically illustrated by way of a working example with reference to the attached drawings.

Figure 1:
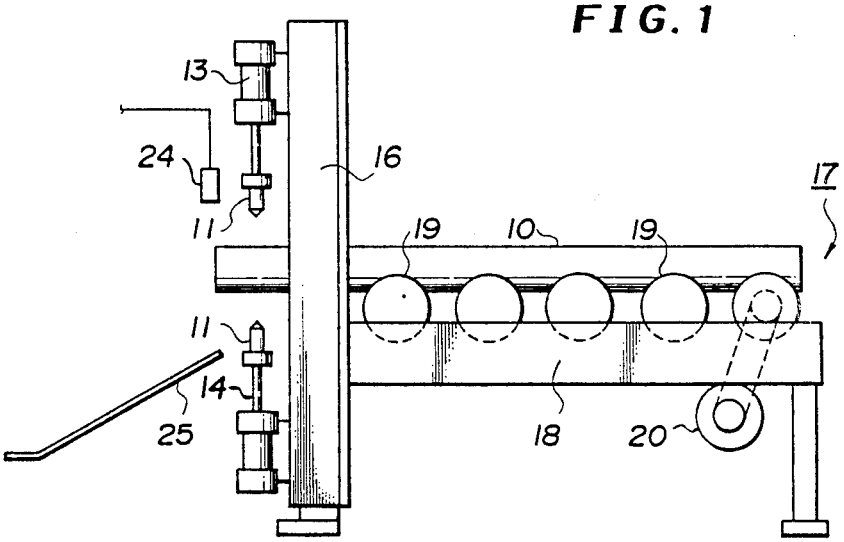
FIG. 1 is an overall elevational side view of an example of the apparatus of the present invention.
Figure 2:
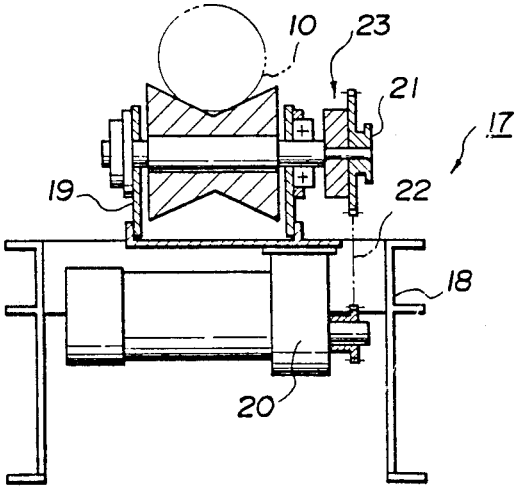
FIG. 2 is a cross-sectional view of the apparatus of FIG. 1 showing the structure of the rod-carrying means.

The overall construction of the apparatus of this invention, with which the method of this invention is carried out, is shown in FIGS. 1 and 2, which represent an example of the invention. The apparatus comprises a vertical stand 16; a supporting rack 18, which is constructed integrally with the vertical stand 16; a plurality of rollers 19, which form a conveyer along the longitudinal length of the support rack; a motor 20 provided at a suitable position in the supporting rack 18 and driving one of the rollers; a plurality of radially and symmetrically arranged cutting edges 11, which are respectively supported on the piston rod 14 of a hydraulic cylinder 13 mounted on the vertical stand 16; a photosensor 24 sensing the end of a silicon rod 10 to be severed; a chute 25, which receives severed lumps of the silicon rod; etc. The rollers are of a hourglass shape.

The rotation of the motor 20 is transmitted to one roller 19 (the first roller in this embodiment) through a chain 22 and a sprocket 21. An electromagnetic clutch 23 is provided thereat so that forwarding and stopping of a rod 10 placed on the rollers can be controlled as intended or as programmed.

Figure 3:
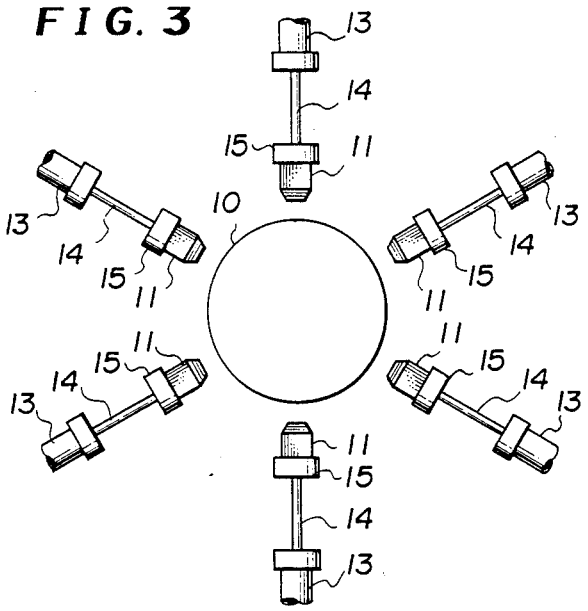
FIG. 3 is a plan view indicating the arrangement of cutting edges in the apparatus as shown in FIG. 1.
Figure 4:
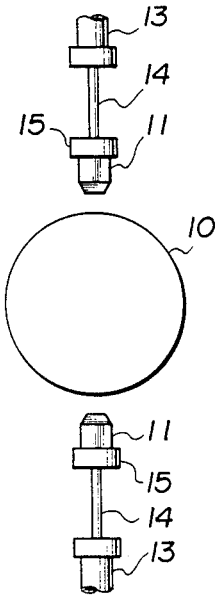
FIGS. 4 and 5 are plan views similar to FIG. 3 showing other arrangements of the cutting edges.
Figure 5:
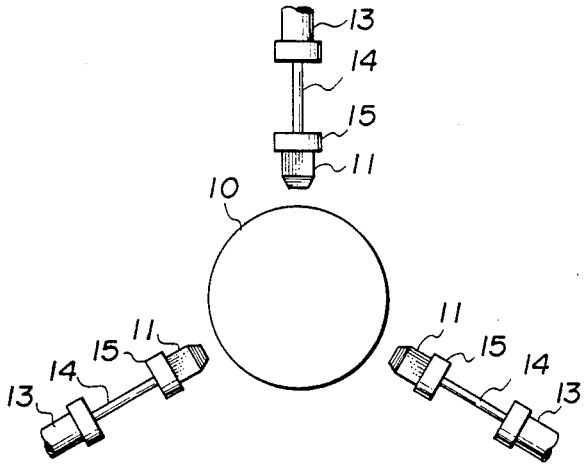
Figure 6:
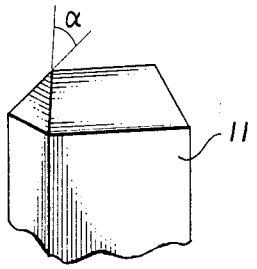
FIG. 6 is a schematic perspective view of a cutting edge showing the edge angle.

In this preferred embodiment, six cutting edges are radially and symmetrically arranged and mounted on the stand 16 as shown in FIG. 3. That is, the six cutting edges are arranged at 60° intervals and directed toward the center of the rod 10 to be cut. A cutting edge tool 11 is secured to the end of the piston rod 14 of each hydraulic cylinder 13 by means of a holder 15. The hydraulic cylinders 13 are operated in the conventional manner as intended or as programmed. The hydraulic cylinders 13 are provided with a common pressure gauge (not shown) and mechanism for varying hydraulic pressure (not shown), and are constructed so that the hydraulic pressure is maintained relatively low and it is automatically raised when the pressure exceeds a predetermined value.

A silicon rod 10 to be cut is placed on the roller conveyer 19 and fed forward to the position of the photosensor 24, that is, to the shearing position by the driving motor 20, Then, operation of the cutting edges starts. The cutting edges are sent out by means of hydraulic pressure. When pressing forces extending the strength of the rod 10 are applied, the rod 10 is instantaneously severed and a cut lump drops into the chute.

The surfaces of the lumps severed by the method of the present invention were found to be as smooth as those severed by the conventional cutting saw.

We claim:

1. A method of cutting a polycrystalline silicon rod comprising:

A. placing the silicon rod on a roller conveyor;

B. feeding the silicon rod to a position adjacent to at least three cutting edges, each cutting edge having an angle of between 60° and 120°, said cutting edges being arranged in a plane perpendicular to, angularly disposed about and equidistantly positioned about said rod;

C. applying a first hydraulic force to each of said at least three cutting edges to bring said edges into engagement with said rod; and D. applying a second hydraulic force greater than the first force to each of said at least three cutting edges to instantaneously sever the rod by brittle fracture along a direction of the pressing forces and in a direction parallel to a circumference of the rod.

2. The method as set forth in claim 1, wherein four cutting edges are located at four positions spaced at 90° intervals and said first force and said second force are applied to each of said four cutting edges.

3. The method as set forth in claim 1, wherein six cutting edges are located at six positions spaced at 60° intervals and said first force and said second force are applied to each of said six cutting edges.

4. A method of cutting a polycrystalline silicon rod, which comprises:

applying a sufficient first force to each of at least three cutting edges to bring said edges into contact with the surface of said rod, said cutting edges being arranged in a plane perpendicular to, angularly disposed about and equidistantly positioned about a longitudinal axis of said rod, each cutting edge being defined by an angle of between 60° and 120°; and applying a second force to each of said at least three cutting edges which said second force is greater than said first force to sever said rod instantaneously.

5. The method as set forth in claim 4, wherein four cutting edges are located at four positions spaced at 90° intervals and said first force and said second force are applied to each of said four cutting edges.

6. The method as set forth in claim 4, wherein six cutting edges are located at six positions spaced at 60° intervals and said first force and said second force are applied to each of said six cutting edges.

7. An apparatus for cutting polycrystalline silicon rod which comprises a means for movably supporting a polycrystalline silicon rod; at least three cutting edges each cutting edge defined by an angle of between 60° and 120° and arranged in a plane perpendicular to, angularly disposed about and equidistantly positioned about the longitudinal axis of the silicon rod adjacent the periphery of the rod said cutting edges being movable in a radial direction; and a means for driving said edges toward the axis of the rod to apply a first force against the rod and thereinafter to apply a second force greater than the first force to sever said rod instantaneously.

8. The apparatus as set forth in claim 7, wherein the angle of each cutting edge is between 75° and 100°.

9. The apparatus for cutting a polycrystalline silicon rod as set forth in claim 7 wherein said means for movably supporting the polycrystalline silicon rod includes a vertical stand; a support rack integrally constructed with said vertical stand; a plurality of rollers having an hourglass shape and forming a conveyor along the longitudinal length of said support rack; and a motor positioned in said support rack and driving one of said rollers for conveying the silicon rod to said plurality of cutting edges.

10. The apparatus for cutting a polycrystalline silicon rod as set forth in claim 7, further including a photosensor spaced from the cutting edges by a distance equal to the length of a lump of rod to be severed.

11. The apparatus for cutting a polycrystalline silicon rod as set forth in claim 7 wherein the means for driving said edges comprises hydraulic cylinders and each hydraulic cylinder includes a piston rod and is positioned in the radial direction of the silicon rod, and wherein one of said cutting edges is secured to the end of each piston rod.

* * * * *